US007799393B2

(12) United States Patent
Chen

(10) Patent No.: US 7,799,393 B2
(45) Date of Patent: Sep. 21, 2010

(54) INK-JET MEDIA COATINGS INCLUDING EXPOXY-FUNCTIONALIZED INORGANIC PARTICULATES AND AMINE-FUNCTIONALIZED INORGANIC PARTICULATES

(75) Inventor: Tienteh Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1348 days.

(21) Appl. No.: 11/053,387

(22) Filed: Feb. 7, 2005

(65) Prior Publication Data

US 2006/0083870 A1 Apr. 20, 2006

Related U.S. Application Data

(60) Provisional application No. 60/620,901, filed on Oct. 20, 2004.

(51) Int. Cl.
*B41M 5/40* (2006.01)
*B41M 3/12* (2006.01)

(52) U.S. Cl. ..... 428/32.34; 428/32.1; 428/195.1; 347/105; 347/106; 427/146

(58) Field of Classification Search ..... 428/32.1, 428/32.34, 195.1; 347/105, 106; 427/146
See application file for complete search history.

(56) References Cited

U.S. PATENT DOCUMENTS

| | | | |
|---|---|---|---|
| 3,886,080 | A | 5/1975 | Schucker et al. |
| 4,714,769 | A | 12/1987 | De Antoniis et al. |
| 4,943,375 | A | 7/1990 | Bradshaw et al. |
| 4,946,557 | A | 8/1990 | Svending |
| 5,179,213 | A | 1/1993 | Bradshaw et al. |
| 5,224,972 | A | 7/1993 | Frye et al. |
| 5,264,275 | A | 11/1993 | Misuda et al. |
| 5,275,867 | A | 1/1994 | Misuda et al. |
| 5,368,833 | A | 11/1994 | Johansson et al. |
| 5,393,892 | A | 2/1995 | Krakowiak et al. |
| 5,411,787 | A | 5/1995 | Kulkarni et al. |
| 5,463,178 | A | 10/1995 | Suzuki et al. |
| 5,547,760 | A | 8/1996 | Tarbet et al. |

(Continued)

FOREIGN PATENT DOCUMENTS

| | | | |
|---|---|---|---|
| EP | 0 663 620 | A | 7/1995 |

(Continued)

OTHER PUBLICATIONS

Machine translation of JP 2002-362048 (Dec. 2002; Hiroshi et al.) - translation includes Abstract, Claims, and Detailed Description.*

(Continued)

*Primary Examiner*—Mark Ruthkosky
*Assistant Examiner*—David J Joy

(57) ABSTRACT

The present invention is drawn to a print medium and a method of preparing the same. The print medium can include a media substrate and a porous ink-receiving layer coated on the media substrate. The porous ink-receiving layer can include metal oxide or semi-metal oxide including a first portion of amine-functionalized particulates and a second portion of epoxy functionalized particulates, wherein at least a portion of the amine functionalized particulates are covalently coupled to at least a portion of the epoxy-functionalized particulates. A binder can optionally be present in the porous ink-receiving layer as well.

26 Claims, 1 Drawing Sheet

U.S. PATENT DOCUMENTS

| | | | | |
|---|---|---|---|---|
| 5,549,740 | A | 8/1996 | Takahashi et al. | |
| 5,643,414 | A | 7/1997 | Johansson et al. | |
| 5,702,610 | A | 12/1997 | Hagen et al. | |
| 5,702,804 | A | 12/1997 | Malhotra | |
| 5,707,493 | A | 1/1998 | Saastamoinen | |
| 5,804,293 | A | 9/1998 | Nehmsmann et al. | |
| 5,858,280 | A | 1/1999 | Zhang et al. | |
| 5,888,625 | A * | 3/1999 | Kobayashi et al. | 428/32.11 |
| 5,965,244 | A | 10/1999 | Tang et al. | |
| 5,985,425 | A | 11/1999 | Tomizawa et al. | |
| 6,103,380 | A | 8/2000 | Devonport | |
| 6,110,601 | A | 8/2000 | Shaw-Klein et al. | |
| 6,126,280 | A | 10/2000 | Hashimoto et al. | |
| 6,183,844 | B1 | 2/2001 | Li | |
| 6,228,475 | B1 | 5/2001 | Chu et al. | |
| 6,265,483 | B1 | 7/2001 | Guilard et al. | |
| 6,337,358 | B1 | 1/2002 | Whitehouse et al. | |
| 6,350,519 | B1 | 2/2002 | Devonport | |
| 6,420,039 | B1 | 7/2002 | Field et al. | |
| 6,447,881 | B1 | 9/2002 | Nishida et al. | |
| 6,458,876 | B1 | 10/2002 | Rabasco et al. | |
| 6,479,203 | B1 | 11/2002 | Tashiro et al. | |
| 6,565,949 | B1 | 5/2003 | Wang et al. | |
| 6,652,085 | B2 | 11/2003 | Tsao | |
| 6,670,002 | B1 | 12/2003 | Sekiguchi et al. | |
| 6,685,770 | B2 | 2/2004 | Adachi et al. | |
| 2002/0144626 | A1 | 10/2002 | Schut | |
| 2003/0064208 | A1 * | 4/2003 | Yamada et al. | 428/195 |
| 2003/0186003 | A1 * | 10/2003 | Nakano et al. | 428/32.1 |

FOREIGN PATENT DOCUMENTS

| | | |
|---|---|---|
| EP | 0696516 | 2/1996 |
| EP | 0716929 | 5/1996 |
| EP | 0 775 590 A | 5/1997 |
| EP | 0937582 | 8/1999 |
| JP | 2002362048 | 12/2002 |
| JP | 200458360 | 2/2004 |
| WO | WO97/20216 | 6/1997 |

OTHER PUBLICATIONS

Machine translation of JP 2004-058360 (Feb. 2004; Kazushige et al.) - translation includes Abstract, Claims, and Detailed Description.*
JP OA dated Jun. 12, 2007.

* cited by examiner

INK-JET MEDIA COATINGS INCLUDING EXPOXY-FUNCTIONALIZED INORGANIC PARTICULATES AND AMINE-FUNCTIONALIZED INORGANIC PARTICULATES

CLAIM OF PRIORITY

This application claims the benefit of U.S. Provisional Patent Application No. 60/620,901, filed on Oct. 20, 2004, which is incorporated by reference herein in its entirety.

FIELD OF THE INVENTION

The present invention relates generally to the preparation of ink receiving layers for ink-jet printing applications. More specifically, the present invention relates to ink receiving layers that include amine-functionalized metal oxide or semi-metal oxide particulates and epoxy-functionalized metal oxide or semi-metal oxide particulates.

BACKGROUND OF THE INVENTION

Ink-jet inks typically comprise an ink vehicle and a colorant, the latter of which may be a dye or a pigment. Dye-based ink-jet inks used in photographic image printing are almost always water-soluble dyes. As a result, such dye-based ink-jet inks are usually not very water fast, i.e. images tend to shift in hue and edge sharpness is reduced upon exposure to humid conditions. In addition, images created from these water-soluble dye-based ink-jet inks tend to fade over time, such as when exposed to ambient light and/or air. Pigment-based inks on the other hand, allow the creation of images that are vastly improved in humid fastness and image fade resistance. Pigment based images, however, are inferior to dye-based ink-jet inks with respect to the desirable trait of color saturation.

Print media surfaces play a key role in the overall quality of ink-jet produced printed images. Papers used for ink-jet printing have typically included high-quality or wood-free papers designed to have high ink absorptivity. These papers are functionally good for ink-jet printing because the ink-jet inks may be absorbed readily and dry quickly. However, such papers often do not allow for a crisp or sharp image. In order to attain enhanced print quality and image quality as in a photograph, special media has been developed to work with aqueous inks, which can be separated into two broad groups: porous media and swellable media.

With porous media, an ink receiving layer can comprise porous metal oxide or semi-metal oxide particulates (usually silica or alumina) bound together by some polymer binder, and optionally, mordants or ionic binding species, e.g., cationic binding species for use with anionic dyes or anionic binding species for use with cationic dyes. During printing, ink is quickly adsorbed onto the surface which is porous in nature, and if an ionic binding species is present, the colorant can be attracted to the ionic species of opposite charge. This type of media has the advantage of relatively short dry-times, good smearfastness, and often, acceptable water and humidity resistance. Conversely, with swellable media, an ink receiving layer is present that comprises a continuous layer of a swellable polymer that is not physically porous. Upon printing, ink is absorbed as water contacts and swells a polymer matrix of the coating. The colorant, which is typically a dye, can be immobilized inside the continuous layer of the polymer with significantly limited exposure to the outside environment. Advantages of this approach include much better fade resistance (in both light and dark conditions) than is present with porous media. However, swellable media requires a longer dry time, is not typically as crisp in image quality, and exhibits poor smearfastness.

Though both swellable media and porous media each provide unique advantages in the area of ink-jet printing, due to the image crispness and fast dry time achievable from porous media, there is some trending in the direction of the use of porous media. However, the preparation of porous media has unique challenges. For example, many porous media formulations tend to crack upon coating on a media substrate and drying, and further, with certain coatings, a hazy appearance of inks printed thereon can occur.

SUMMARY OF THE INVENTION

In accordance with embodiments of the present invention, it has been recognized that the preparation of porous ink-receiving layers that exhibit reduced cracking upon drying, reduced ink haze upon printing, increased ink absorption rates, and/or improved color gamut would be an advancement in the art. In accordance with this, the present invention is drawn to a print medium and a method of preparing the same. The print medium can include a media substrate and a porous ink-receiving layer coated on the media substrate. The porous ink-receiving layer can include metal oxide or semi-metal oxide particulates including a first portion of amine-functionalized particulates and a second portion of epoxy functionalized particulates, wherein amine functionalized particulates are covalently coupled to epoxy-functionalized particulates.

A method of preparing a print medium is also disclosed and can comprise steps of coating a media substrate with a coating composition to form an ink-receiving layer. The coating composition can include metal oxide or semi-metal oxide particulates including a first portion of amine-functionalized particulates and a second portion of epoxy functionalized particulates, wherein amine functionalized particulates are covalently coupled to epoxy-functionalized particulates.

Additional features and advantages of the invention will be apparent from the following detailed description which illustrates, by way of example, features of the invention.

DETAILED DESCRIPTION OF THE PREFERRED EMBODIMENT(S)

Figure 1:
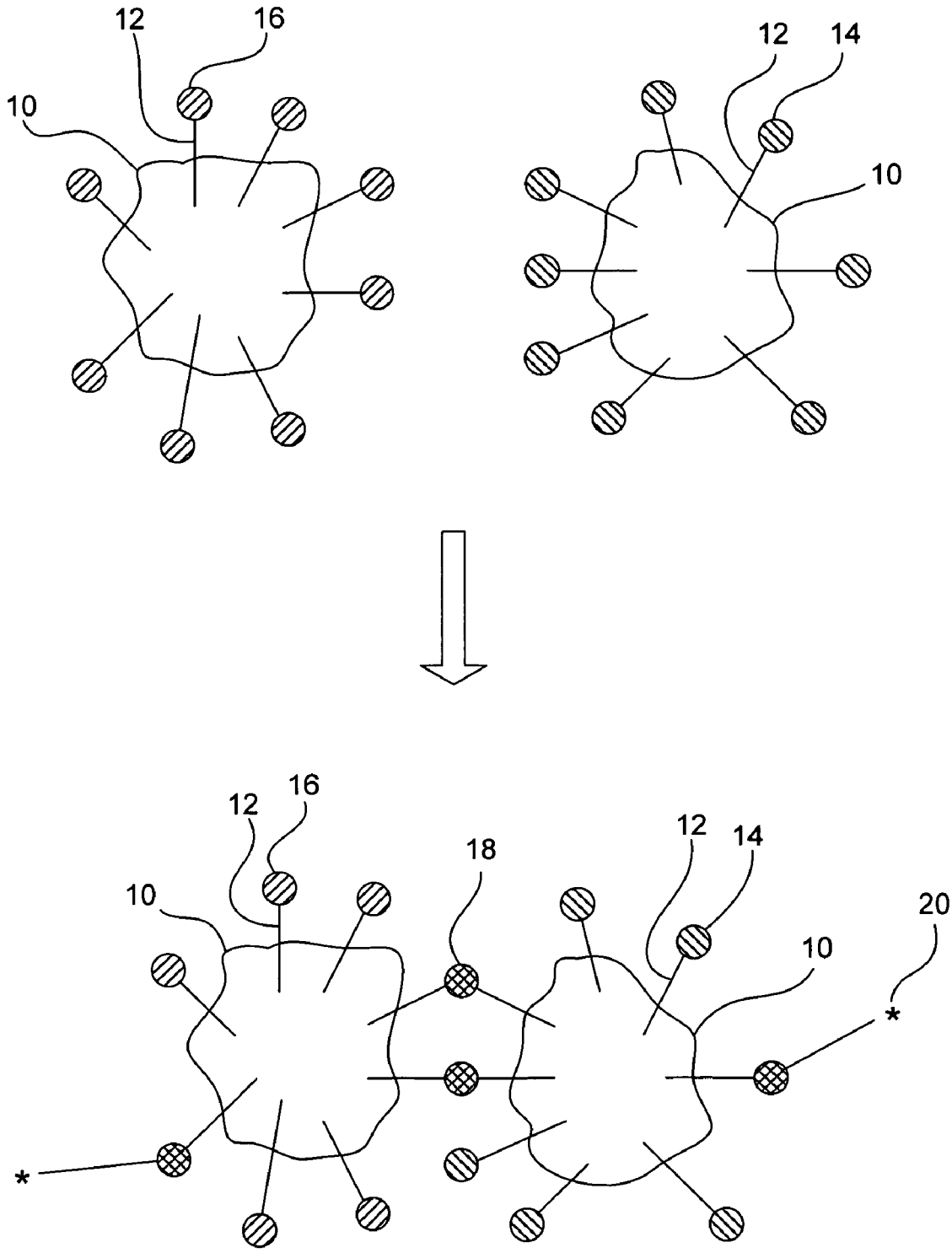
FIG. 1 is a schematic representation depicting the covalent coupling of an amine-functionalized metal oxide or semi-metal oxide particulate with an epoxy-functionalized metal oxide or semi-metal oxide particulate.

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a dye" includes reference to one or more of such materials.

"Media substrate" or "substrate" includes any substrate that can be coated with a coating composition (to form an ink-receiving layer) of the present invention, and can include papers, overhead projector plastics or films, coated papers such as photobase, fabric, art paper such as water color paper, or the like.

"Porous media" refers to any substantially inorganic particulate-containing coated media having surface voids and/or cavities capable of taking in the ink-jet inks in accordance with embodiments of the present invention. Typically, porous media includes a substrate and a porous ink-receiving layer. As ink is printed on the porous media, the ink can fill the voids and the outermost surface can become dry to the touch in a more expedited manner as compared to traditional or swellable media. Common inorganic particulates that can be present in the coatings include metal oxide or semi-metal oxide particulates, such as silica or alumina, for example. Additionally, in accordance with embodiments of the present invention, the coating can be bound together by a polymeric binder, and can optionally include mordants or ionic binding species that are attractive of classes of predetermined dye species.

"Organosilane reagent" or "reagent" includes compositions that comprise a functional moiety (or portion of the reagent that provides desired modified properties to an inorganic particulate surface), which is covalently attached to a silane grouping. The organosilane reagent can become covalently attached or otherwise attracted to the surface of metal oxide or semi-metal oxide particulates. The functional moiety portion of the organosilane reagent can be directly attached to the silane grouping, or can be appropriately spaced from the silane grouping, such as by from 1 to 10 carbon atoms or other known spacer groupings. The silane grouping of the organosilane reagent can be attached to inorganic particulates of the porous media coating composition through hydroxyl groups, halo groups, or alkoxy groups present on the reagent. Alternatively, in some instances, the organosilane reagent can be merely attracted to the surface of the inorganic particulates.

The term "functional moiety" refers to an active portion of an organosilane reagent that provides a function to the surface of the metal oxide or semi-metal oxide particulates. In accordance with embodiments of the present invention, the functional moiety can be an amine functionality or an epoxy functionality.

The term "lower" when referring to organic compounds or groups (when not otherwise specified) can contain from 1 to 8 carbons. For example, lower alkoxy can include methoxy, ethoxy, propoxy, butoxy, etc. Additionally, lower alkyl can include methyl, ethyl, propyl, isopropyl, butyl, t-butyl, hexyl, etc.

The term "about" when referring to a numerical value or range is intended to encompass the values resulting from experimental error that can occur when taking measurements.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

With these definitions in mind, the present invention is drawn to a print medium and a method of preparing the same. The print medium can include a media substrate and a porous ink-receiving layer coated on the media substrate. The porous ink-receiving layer can include metal oxide or semi-metal oxide particulates including a first portion of amine-functionalized particulates and a second portion of epoxy functionalized particulates, wherein amine functionalized particulates are covalently coupled to epoxy-functionalized particulates. In one embodiment, optional binder can be present to further bind the ink-receiving layer together.

A method of preparing a print medium is also disclosed and can comprise steps of coating a media substrate with a coating composition to form an ink-receiving layer. The coating composition can include metal oxide or semi-metal oxide particulates including a first portion of amine-functionalized particulates and a second portion of epoxy functionalized particulates, wherein amine functionalized particulates are covalently coupled to epoxy-functionalized particulates. Again, in one embodiment, optional binder can be present in the coating composition to further bind the ink-receiving layer together upon application.

In accordance with embodiments related to the print medium and method of preparing the same, reference is now made to FIG. 1. Specifically, two metal oxide or semi-metal oxide particulates 10 are shown. Each of these two particulates can be of the same material, or of a different material. For example, both can be silica, both can be alumina, or one can be silica and the other can be alumina. One of the particulates has an amine group 14 attached thereto by a coupling group 12. In one embodiment, the amine group and the coupling group can collectively be an organosilane reagent that is reacted with the metal oxide or semi-metal oxide particulate. The other of the particulates shown has an epoxy group 16 attached thereto by a coupling group 12. As before, in one embodiment, the epoxy group and the coupling group can collectively be an organosilane reagent that is reacted with the metal oxide or semi-metal oxide particulate. When the two functionalized particulates are brought together for reaction, the amine group and epoxy group of the different particulates can form a covalent linkage 18, which is a reaction product of the amine and the epoxy groups. Four of such reactions are shown in the present embodiment. Asterisks 20 are shown to depict that each of the particulates can also react with other adjacent particulates in the system.

Porous Media Coatings

Inorganic porous particulate-coated print media typically includes a substrate and a porous ink-receiving layer deposited on the substrate. The substrate can be paper, plastic, coated paper, fabric, art paper, or other known substrate used in the ink-jet printing arts. In one embodiment, photobase can be used as the substrate. Photobase is typically a three-layered system comprising a single layer of paper sandwiched by two polymeric layers, such as polyethylene layers.

With respect to the porous ink-receiving layer, inorganic metal oxide or semi-metal oxide particulates, and optionally, polymeric binder, mordants, and/or other porous coating composition agents can be present. In one embodiment, the inorganic metal oxide or semi-metal oxide particulates can be silica, alumina, boehmite, silicates (such as aluminum silicate, magnesium silicate, and the like), titania, zirconia, calcium carbonate, clays, and combinations thereof. More commonly, the particulates can be alumina or silica. Each of these inorganic particulates can be dispersed throughout a porous coating composition, which can be applied to a media substrate to form the porous ink-receiving layer. Typically, the inorganic particulates are present in the coating composition at from 60 wt % to 95 wt %.

In order to enhance the binding power of the inorganic particulates in the coating composition, though not required, a polymeric binder can be included. Exemplary polymeric binders that can be used include polyvinyl alcohols including water-soluble copolymers thereof, e.g., copolymers of polyvinyl alcohol and poly(ethylene oxide) or copolymers of polyvinyl alcohol and polyvinylamine; cationic polyvinyl alcohols; acetoacetylated polyvinyl alcohols; polyvinyl acetates; polyvinyl pyrrolidones inclduing copolymers of polyvinyl pyrrolidone and polyvinyl acetate; modified starches including oxidized and etherified starches; water soluble cellulose derivatives including carboxymethyl cellulose, hydroxyethyl cellulose; polyacrylamide including its derivatives and copolymers; casein; gelatin; soybean protein; silyl-modified polyvinyl alcohol; conjugated diene copolymer latexes including maleic anhydride resin and styrene-butadiene copolymer; acrylic polymer latexes including polymers and copolymers of acrylic and methacrylic acids; vinyl polymer latexes including ethylene-vinyl acetate copolymers; functional group-modified latexes including those obtained by modifying the above-mentioned polymers with monomers containing functional groups (e.g. carboxyl, amino, amido, sulfo, etc.); aqueous binders of thermosetting resins including melamine resins, and urea resin; synthetic resin binders including polymethyl methacrylate, polyurethane resin, polyester resin, amide resin, vinyl chloride-vinyl acetate copolymer, polyvinyl butyral, and alkyl resins.

In accordance with embodiments of the present invention, the binder can be present to adequately bind the porous ink-receiving layer together without resulting in cracking after drying, but at the same time, can also be present in small enough amounts to maintain the porous nature of the porous ink-receiving layer. In accordance with these competing objectives, it has been discovered that by modifying a first portion of the metal oxide or semi-metal oxide particulates with an amine functionality, and modifying a second portion with an epoxy functionality, less binder can be desirable for use than would otherwise be necessary. In fact, in one embodiment, no binder at all is required due to the reaction between the amine functionalities and epoxy functionalities forming interparticulate bonds. In either case, with from less than typical to no binder present, the porous nature of the ink-receiving layer can be increased without the undesired byproduct of ink-receiving layer cracking after drying. This being stated, though less binder is required, traditional amounts of binder can also be present.

In more detail, by including both amine-functionalized metal oxide or semi-metal oxide particulates and epoxy-functionalized metal oxide or semi-metal oxide particulates in a common coating composition, the amine groups can react with the epoxy groups, thereby covalently binding adjacent particulates together. For example, in one embodiment, a first portion of the metal oxide or semi-metal oxide particulates can be treated with primary, secondary, or tertiary amine silane coupling agents, and a second portion of the metal oxide or semi-metal oxide particulates can be treated with epoxy silane coupling agents. A reaction can be generated, and thus, from little to no binder may be required to bind the ink-receiving layer together. For example, in accordance with embodiments of the present invention, if present, the polymeric binder can be present in the coating composition at from 0.01 wt % to 40 wt % relative to the total weight of semi-metal oxide or metal oxide particulates. In another embodiment, the binder can be added at from 0.01 wt % to 20 wt %.

The ratio of the amine-functionalized metal oxide or semi-metal oxide particulates to epoxy-functionalized metal oxide or semi-metal oxide particulates can be about 1:1, assuming an approximate number of amine groups and epoxy groups are each present on their respective particulates. Alternatively, regardless of the number of respective amine groups and epoxy groups present on the particulates, the molar ratio of amine groups to epoxy groups can be about 1:1. This range is provided to describe an optimal system where there an epoxy group present for reaction for every amine group that is present. In an alternative embodiment, the molar ratio of amine groups to epoxy groups can be from about 3:1 to 1:3. In addition, an external curing agent can be added to speed up the curing reaction between the amine functionalized and epoxy functionalized metal oxide or semi-metal oxide. For example, if present, the curing agent can be included in the coating composition at from 0.01% to 20% by moles based on the total amount of epoxy functional groups. Example of curing agents suitable for use include aliphatic diamines such as polymethylene diamine, polyether diamine, and branched polymethylene diamine; linear and branched aliphatic polyamines, such as diethylenetriamine, iminobispropylamine, bis(hexamethylene)triamine, triethylenetetramine, tetraethylenepentamine, pentaethylenehexamine, dimethylaminopropyamine, diethyleaminopropylamine, aminoethylethanolamine, and methyliminobispropylamine; alicyclic polyamines such as menthane diamine, N-aminoethylpiperazine, 1,3-diaminocyclohexane, and isophoronediamine; aliphatic amines containing aromatic groups such as m-xylylenediamine and tetrachloro-p-xylenediamine; aromatic primary amines such as m-phenylenediamine (MPDA), 4,4'-methylenedianiline (MDA), diaminodiphenylsulfone (DADPS), and aniline-formaldehyde resins; tertiary amines such as N,N'-dimethylpiperazine, hexamethylenetetramine, triethanolamine, 2-methylamino-2-hydroxypropane, benzyldiemthylamine, 2-(dimethylaminoethyl)phenol (DMP-10), and 2,4,6-tris(dimethylaminomethyl)phenol (DMP-30); and other curing agents such as Lewis acids, blocked Lewis acids, $BF_3$ monoethylamine, $BF_3$ Piperidine, boron-nitrogen complexes, metal salts and oxides, amphoteric oxides, phenolic curing agents, phenol-formaldehyde curing agents, Novolac resins, Resole resins, non-carboxylic acid curing agents, organic acid curing agents, etc.

Though the reaction between an amine and an epoxy will typically occur upon drying, the reaction speed can be increased by including a reaction catalyst in the coating composition, such as a tertiary amine, benzyldimethylamine, boron trifluoride monoethylamine, and/or 2-methylimidazole. If the catalyst is included, it can be present at from 1% to 5% by moles based on the total amount of amine or epoxy functional groups present.

In still another embodiment, additional treated metal oxide or semi-metal oxide particulates can also be present, such as a third portion of organosilane reagent metal oxide or semi-metal oxide particulates treated with quaternary ammonium group, or a third portion of metal oxide or semi-metal oxide particulates treated with aluminum chloride hydrate, also known as ACH. The addition of these compositions can improve the performance of certain ink-jet recording inks and other materials.

Optionally, the porous ink-receiving layer can also be modified with an ionic binding species or mordant known to interact with a predetermined class of colorants, thereby increasing permanence. Typical mordants that can be included in the coating composition (and thus, included in the porous ink-receiving layer) include hydrophilic, water dispersible, or water soluble polymers having cationic groups (primary amine, secondary amine, tertiary amine, quaternary amine, amidoamino, pyridine, imine, imidazole, and the like). These cationically modified polymers can be compatible with water-soluble or water dispersible binders and have little or no adverse effect on image processing or colors present in the image. Suitable examples of such polymers include, but are not limited to, polyquaternary ammonium salts, cationic polyamines, polyamidins, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin, a polyallylamine; a polyvinylamine; a dicyandiamide-polyalkylenepolyamine condensate; a polyalkylenepolyamine-dicyandiamideammonium condensate; a dicyandiamide-formalin condensate; an addition polymer of epichlorohydrin-dialkylamine; a polymer of diallyldimethylammoniumchloride ("DADMAC"); a copolymer of diallyldimethylammoniumchloride-$SO_2$, polyvinylimidazole, polyvinypyrrolidone; a copolymer of vinylimidazole, polyamidine, chitosan, cationized starch, polymers of vinylbenzyltrimethylqammoniumchloride, (2-methacryloyloxyethyl)trimethyl-ammoniumchloride, and polymers of dimethylaminoethylmethacrylate; or a polyvinylalcohol with a pendant quaternary ammonium salt. Examples of the water-soluble cationic polymers that are available in latex form and are suitable as mordants are TruDot P-2604, P-2606, P-2608, P-2610, P-2630, and P-2850 (available from MeadWestvaco Corp. of Stamford, Conn.), and Rhoplex Primal-26 (available from Rohm and Haas Co. of Philadelphia, Pa.).

Aside from mordants, other optional components that can be present in the porous ink-receiving layer can include anionic surfactants, cationic surfactants, biocides, plasticizers, optical brighteners, viscosity modifiers, leveling agents, UV absorbers, hindered amine stabilizers, anti-ozonants, silane coupling agents, and/or other known additives.

The ink-receiving layer can be a single layer or a multilayer coating designed to absorb sufficient quantities of ink to produce high quality printed images. The coating composition can be applied to the media substrate to form the ink-receiving layer by any means known to one skilled in the art, including blade coating, air knife coating, rod coating, wire rod coating, roll coating, slot coating, slide hopper coating, gravure, curtain, or cascade coating. The ink-receiving layer can be printed on one or both sides of the media substrate. In one embodiment of the present invention, the thickness of the ink-receiving layer formed by the coating composition can be from about 20 μm to about 60 μm. If applied as a second media topcoat, the thickness can range from 0.1 μm to 10 μm, and in a more specific embodiment, from 1 μm to 5 μm.

Surface Modification of Metal Oxide or Semi-Metal Oxide Particulates

In accordance with embodiments of the present invention, amine-functionalized and epoxy-functionalized organosilane reagents can be used to modify semi-metal oxide and metal oxide particulates. To illustrate a sample organosilane reagent that can be used to modify such particulates, Formula 1 is provided, as follows:

Formula 1

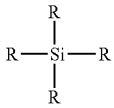

In Formula 1 above, from 0 to 2 of the R groups can be H, —$CH_3$, —$CH_2CH_3$, or —$CH_2CH_2CH_3$; from 1 to 3 of the R groups can be halo or alkoxy; and from 1 to 3 of the R groups can include an epoxy functionality or an amine functionality. R can also include a spacer group that separates the amine or epoxy group form the silane group, as is known in the art. If halo is present, then Formula 1 can be said to be an organohalosilane reagent. If alkoxy is present, then Formula 1 can be said to be an organoalkoxysilane reagent.

Examples of amine-functionalized organosilane reagents include 3-aminopropyltrimethoxysilane, 3-aminopropyltriethoxysilane, 3-aminoethylaminopropyltrimethoxysilane, 3-aminoethylaminopropyltriethoxysilane, 3-aminoethylaminoethylaminopropyltrimethoxysilane, 3-aminoethylaminoethylaminopropyltriethoxysilane, 3-aminopropylsilsesquioxane, bis-(3-trimethoxysilylpropyl)amine, N-benzyl-N-aminoethyl-3-aminopropyltrimethoxysilane hydrochloride, N-phenyl-3-aminopropyltrimethoxysilane, N-(2-aminoethyl-3-aminopropyltrimethoxysilane, 3-(triethoxysilylpropyl)-diethylenetriamine, poly(ethyleneimine) trimethoxysilane, or the like. Examples of quaternary ammonium salts that can also be used include the quaternary ammonium salts of the amine-functionalized organosilane reagents described above. A specific example of such a quaternary ammonium salt of an organosilane reagent includes trimethoxysilylpropyl-N,N,N-trimethylammonium chloride.

Examples of epoxy-functionalized organosilane reagents include 3-glycidoloxypropyltrimethoxysilane, beta-(3,4-epoxycyclohexyl) ethyltrimethoxysilane, beta-(3,4-epoxycyclohexyl) ethyltriethoxysilane, 5,6-epoxyhexyltrimethoxysilane, epoxypropylheptaisobutyl-T8-silsesquioxane, 3-(glycidoxypropyl)dimethylethoxysilane, (3-glycidoxypropyl)methyldiethoxysilane, (3-glycidoxypropyl)methyldimethoxysilane, or the like.

The reaction between the organosilane reagents and the metal oxide or semi-metal oxide particulates can be performed in either organic solvents or in an aqueous dispersion. This later method can be desirable for manufacturing purposes, as the preparation of a hydrophilic ink-receiving layer can be carried out with a reduced number of steps when each of the steps are carried out in an aqueous environment.

Ink-Jet Printing Systems

Ink-jet inks that can be used to print on the print media of the present invention include pigment-based and dye-based ink-jet inks. Though any effective amount of colorant can be used, the ink-jet ink can include from 0.1 wt % to 10 wt % of colorant.

With respect to embodiments where dye-based ink-jet inks are used, examples of suitable anionic dyes include a large number of water-soluble acid and direct dyes. Specific examples of anionic dyes include the Direct Yellow 86, Acid Red 249, Direct Blue 199, Direct Black 168, Reactive Black 31, Direct Yellow 157, Reactive Yellow 37, Acid Yellow 23, Reactive Red 180, Acid Red 52, Acid Blue 9, Direct Red 227, Acid Yellow 17, Direct Blue 86, Reactive Red 4, Reactive Red 56, Reactive Red 31, and Direct Yellow 132; Aminyl Brilliant Red F-B (Sumitomo Chemical Co.); the Duasyn line of "salt-free" dyes available from Hoechst; mixtures thereof; and the like. Further examples include Bernacid Red 2BMN, Pontamine Brilliant Bond Blue A, BASF X-34, Pontamine, Food Black 2, Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz, Inc.), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; Pro-Jet 485 (a copper phthalocyanine); Magenta 377; mixtures thereof, and the like. This list is intended to be merely exemplary, and should not be considered limiting.

Similarly, a wide variety of pigments can be used in pigment-based ink-jet inks, including black pigments, cyan pigments, magenta pigments, yellow pigments, or the like. Examples of black pigments that can be used include carbon pigments. The carbon pigment can be almost any commercially available carbon pigment that provides acceptable optical density and print characteristics. Carbon pigments suitable for use in the present invention include, without limitation, carbon black, graphite, vitreous carbon, charcoal, and combinations thereof. Such carbon pigments can be manufactured by a variety of known method such as a channel method, a contact method, a furnace method, an acetylene method, or a thermal method, and are commercially available from such vendors as Cabot Corporation, Columbian Chemicals Company, Degussa AG, and E.I. DuPont de Nemours and Company. Suitable carbon black pigments include, without limitation, Cabot pigments such as MONARCH 1400, MONARCH 1300, MONARCH 1100, MONARCH 1000, MONARCH 900, MONARCH 880, MONARCH 800, MONARCH 700, CAB-O-JET 200, and CAB-O-JET 300; Columbian pigments such as RAVEN 7000, RAVEN 5750, RAVEN 5250, RAVEN 5000, and RAVEN 3500; Degussa pigments such as Color Black FW 200, RAVEN FW 2, RAVEN FW 2V, RAVEN FW 1, RAVEN FW 18, RAVEN S160, RAVEN FW S170, Special Black 6, Special Black 5, Special Black 4A, Special Black 4, PRINTEX U, PRINTEX 140U, PRINTEX V, and PRINTEX 140V; and TIPURE R-101 available from Dupont. The above list of pigments includes unmodified pigment particulates, small molecule attached pigment particulates, and polymer-dispersed pigment particulates.

A wide variety of colored pigments can also be used with the coated media of the present invention, and as such, the following list is not intended to be limiting. The following color pigments are available from Cabot Corp.: CABO-JET 250C, CABO-JET 260M, and CABO-JET 270Y. The following color pigments are available from BASF Corp.: PALIOGEN Orange, HELIOGEN Blue L 6901F, HELIOGEN Blue NBD 7010, HELIOGEN Blue K 7090, HELIOGEN Blue L 7101F, PALIOGEN Blue L 6470, HELIOGEN Green K 8683, and HELIOGEN Green L 9140. The following pigments are available from Ciba-Geigy Corp.: CHROMOPHTAL Yellow 3G, CHROMOPHTAL Yellow GR, CHROMOPHTAL Yellow 8G, IGRAZIN Yellow 5GT, IGRALITE Rubine 4BL, MONASTRAL Magenta, MONASTRAL Scarlet, MONASTRAL Violet R, MONASTRAL Red B, and MONASTRAL Violet Maroon B. The following pigments are available from Heubach Group: DALAMAR Yellow YT-858-D and HEUCOPHTHAL Blue G XBT-583D. The following pigments are available from Hoechst Specialty Chemicals: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, NOVOPERM Yellow HR, NOVOPERM Yellow FGL, Hansa Brilliant Yellow 10GX, Permanent Yellow G3R-01, HOSTAPERM Yellow H4G, HOSTAPERM Yellow H3G, Hostaperme Orange GR, HOSTAPERM Scarlet GO, and Permanent Rubine F6B. The following pigments are available from Mobay Corp.: QUINDO Magenta, INDOFAST Brilliant Scarlet, QUINDO Red R6700, QUINDO Red R6713, and INDOFAST Violet. The following pigments are available from Sun Chemical Corp.: L74-1357 Yellow, L75-1331 Yellow, and L75-2577 Yellow.

As mentioned, the ink-jet ink compositions of the present invention are typically prepared in an aqueous formulation or liquid vehicle which can include water, cosolvents, surfactants, buffering agents, biocides, sequestering agents, viscosity modifiers, humectants, binders, and/or other known additives. In one aspect of the present invention, the liquid vehicle can comprise from about 70 wt % to about 99.9 wt % of the ink-jet ink composition. In another aspect, other than the colorant, liquid vehicle can also carry polymeric binders, latex particulates, and/or other solids.

As described, cosolvents can be included in the ink-jet compositions of the present invention. Suitable cosolvents for use in the present invention include water soluble organic cosolvents, but are not limited to, aliphatic alcohols, aromatic alcohols, diols, glycol ethers, poly(glycol) ethers, lactams, formamides, acetamides, long chain alcohols, ethylene glycol, propylene glycol, diethylene glycols, triethylene glycols, glycerine, dipropylene glycols, glycol butyl ethers, polyethylene glycols, polypropylene glycols, amides, ethers, carboxylic acids, esters, organosulfides, organosulfoxides, sulfones, alcohol derivatives, carbitol, butyl carbitol, cellosolve, ether derivatives, amino alcohols, and ketones. For example, cosolvents can include primary aliphatic alcohols of 30 carbons or less, primary aromatic alcohols of 30 carbons or less, secondary aliphatic alcohols of 30 carbons or less, secondary aromatic alcohols of 30 carbons or less, 1,2-diols of 30 carbons or less, 1,3-diols of 30 carbons or less, 1,5-diols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, lactams, substituted formamides, unsubstituted formamides, substituted acetamides, and unsubstituted acetamides. Specific examples of cosolvents that are preferably employed in the practice of this invention include, but are not limited to, 1,5-pentanediol, 2-pyrrolidone, 2-ethyl-2-hydroxymethyl-1,3-propanediol, diethylene glycol, 3-methoxybutanol, and 1,3-dimethyl-2-imidazolidinone. Cosolvents can be added to reduce the rate of evaporation of water in the ink-jet to minimize clogging or other properties of the ink such as viscosity, pH, surface tension, optical density, and print quality. The cosolvent concentration can range from about 1 wt % to about 40 wt %, and in one embodiment is from about 2 wt % to about 30 wt %. Multiple cosolvents can also be used, as is known in the art.

Various buffering agents or pH adjusting agents can also be optionally used in the ink-jet ink compositions of the present invention. Typical buffering agents include such pH control solutions as hydroxides of alkali metals and amines, such as lithium hydroxide, sodium hydroxide, potassium hydroxide; citric acid; amines such as triethanolamine, diethanolamine, and dimethylethanolamine; hydrochloric acid; and other basic or acidic components which do not substantially interfere with the bleed control or optical density characteristics of the present invention. If used, buffering agents typically comprise less than about 10 wt % of the ink-jet ink composition.

In another aspect of the present invention, various biocides can be used to inhibit growth of undesirable microorganisms. Several non-limiting examples of suitable biocides include benzoate salts, sorbate salts, commercial products such as NUOSEPT (Nudex, Inc., a division of Huls America), UCARCIDE (Union Carbide), VANCIDE (RT Vanderbilt Co.), and PROXEL (ICI Americas) and other known biocides. Typically, such biocides comprise less than about 5 wt % of the ink-jet ink composition and often from about 0.1 wt % to about 0.25 wt %.

In an additional aspect of the present invention, binders can be included in the liquid vehicle of the ink-jet ink which acts to secure the colorants on the substrate. Binders suitable for use in the present invention typically have a molecular weight of from about 1000 Mw to about 3,000,000 Mw. Non-limiting examples include polyester, polyester-melanine, styrene-acrylic acid copolymers, styrene-acrylic acid-alkyl acrylate copolymers, styrene-maleic acid copolymers, styrene-maleic acid-alkyl acrylate copolymers, styrene-methacrylic acid copolymers, styrene-methacrylic acid-alkyl acrylate copolymers, styrene-maleic half ester copolymers, vinyl naphthalene-acrylic acid copolymers, vinyl naphthalene-maleic acid copolymers, and salts thereof.

If surfactants are present, then typical water-soluble surfactants such as TRITONS™ (including ethoxylated octylphenols), IGEPALS™ (including alkyl phenoxypoly (ethleneoxy) ethanols), SILWETS™ (including silicone glycol copolymers including polyalkylene oxide-modified polydimethylsiloxanes, SURFYNOLS™ (including ethoxlyated tetramethyl decyndiols), TERGITOLS™ (including ethoxylated trimethylnonanols), BRIJS™ (including polyoxyethylene ethers), PLURONICS™ (including ethylene oxide/propylene oxide copolymers), FLUORADS™ and ZONYLS™ (including fluorosurfactants), and NEODOLS™ (including nonionic ethoxylated surfactants). Other surfactants or wetting agents that can be used include Wetting Olin10G, alkyl polyethylene oxides, alkyl phenyl polyethylene oxides, polyethylene oxide (PEO) block copolymers, acetylenic PEO, PEO esters, PEO amines, PEO amides, and dimethicone copolyols. Any of these surfactants, or combination of these surfactants or other surfactants, can be present at from 0.01 wt % to about 10 wt % of the ink-jet ink composition.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what are presently deemed to be the most practical and preferred embodiments of the invention.

Example 1

Preparation of First Silica Dispersion with Epoxy Functional Groups (Silica E1)

About 200 g of a fumed silica dispersion (pre-dispersed from Cabot Chemical Corp., 20% solid) was charged to a beaker. The beaker was placed in a sonication bath and stirred with a mechanical stirrer. The pH of the silica was adjusted to 3.5 with 10% hydrochloric acid. About 6 g of Silquest A-187 (gamma-glycidoxypropyltrimethoxysilane in 20% methanol solution) was added drop wise to the silica dispersion with sonication and stirring. The pH of the dispersion was adjusted to between 3.5 and 4.0 with addition of diluted hydrochloric acid or ammonium hydroxide. Sonication was continued for 15 minutes after the addition of the Silquest A-187. The mixture was stirred overnight at room temperature, and the final % solid was 20.21% and the pH was 3.6.

Example 2

Preparation of Second Silica Dispersion with Epoxy Functional Groups (Silica E2)

The same procedure as described in Example 1 was followed, except that the reagent used to modify the fumed silica was Silquest A-186 (beta-(3,4-epoxycyclohexyl)ethyltrimethoxysilane). The final % solid as 20.3% and the pH was 3.45.

Example 3

Preparation of Silica Dispersion with Amine Functional Group (Silica A1)

About 200 g of a fumed silica dispersion (pre-dispersed from Cabot Chemical Corp., 20% solid) was charged to a beaker. The beaker was placed in a sonication bath and stirred with a mechanical stirrer. The pH of the silica was adjusted carefully to 2.0 with 10% hydrochloric acid. About 6 g of Silquest A-1120 (2-aminoethylaminopropyltrimethoxysilane in 20% methanol solution) was added drop wise to the silica dispersion with sonication and stirring. The pH of the dispersion was adjusted to below 4.0 with addition of 3% ammonium hydroxide. Sonication was continued for 15 minutes after the addition of the Silquest A-1120. The mixture was continued to be stirred overnight at room temperature, and the final % solid was 19.95% and the pH was about 3.7.

Example 4

Preparation of Silica Dispersion with Amine Functional Group (Silica A2)

The same procedure as described in Example 3 was followed, except that the reagent used to modify the fumed silica was Silquest A-1130 (triaminofunctional silane). The final % solid was 19.78% and the pH was about 3.6.

Example 5

Preparation of Coating Formulations

Four coating formulations (Formulations 1-4) were prepared that included the epoxy silica of Example 1 (Silica E1) and either the amine silica of Example 3 (Silica A1) or the amine silica of Example 4 (Silica A2). Two additional coating formulations (Formulations 5 and 6) were prepared that included only one type of modified silica. The coating formulations prepared are included in Table 1, as follows:

TABLE 1

Coating Formulations

| | Formulation | | | | | |
|---|---|---|---|---|---|---|
| | 1 | 2 | 3 | 4 | 5 | 6 |
| Silica E1 | 50 | 50 | 50 | 50 | — | 100 |
| Silica A1 | 50 | — | 50 | — | 100 | — |
| Silica A2 | — | 50 | — | 50 | — | — |
| Mowiol 26-88 | 16 | 16 | 16 | 16 | 16 | 16 |
| Diethylenetriamine | 0 | 0 | 2 | 2 | 0 | 0 |
| Boric Acid | 3.6 | 3.6 | 3.6 | 3.6 | 3.6 | 3.6 |
| Olin 10G | 0.5 | 0.5 | 0.5 | 0.5 | 0.5 | 0.5 |
| Diethyleneglycol | 2 | 2 | 2 | 2 | 2 | 2 |
| % Solid | 17 | 17 | 17 | 17 | 17 | 17 |

Example 6

Comparative Print Results

Each of the coating formulations described in Table 1 were coated on a gel-subbed photo paper with a Mylar rod to give a dry coat weight of 30 g/m$^2$. A test plot was printed on these coatings with a HP DeskJet 970 printer. On a visual scale from 1 to 5, with 5 being the best, the image quality of each print was evaluated under several categories, and the results are summarized in Table 2, as follows:

TABLE 2

Print results

| | Formulation | | | | | |
|---|---|---|---|---|---|---|
| | 1 | 2 | 3 | 4 | 5 | 6 |
| Color Gamut | 4 | 4 | 4 | 4 | 2 | 2 |
| Coalescence | 4 | 4 | 4 | 4 | 4 | 4 |
| Humid Bleed | 4.5 | 4.5 | 4.5 | 4.5 | 4 | 1 |
| Water Fastness | 4.5 | 4.5 | 4.5 | 4.5 | 4 | 1 |
| Cracking | 5 | 4.8 | 4.8 | 5 | 1 | 1 |

As can be seen by Table 2 above, compositions that included both an amine modified silica and a epoxy modified silica (Formulations 1-4) provided from the same to significantly improved results across the board compared to compositions that included only one or the other of the amine modified silica and a epoxy modified silica (Formulations 5 and 6).

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

The invention claimed is:

1. A print medium, comprising:

a) a media substrate; and b) a porous ink-receiving layer coated on the media substrate, said porous ink-receiving layer having metal oxide or semi-metal oxide particulates including a first portion of amine-functionalized particulates and a second portion of epoxy functionalized particulates, wherein amine functionalized particulates are covalently coupled to epoxy-functionalized particulates, and wherein the molar ratio of amine groups of the amine-functionalized particulates to epoxy groups of the epoxy-functionalized particulates is from about 3:1 to 1:3.

2. A print medium as in claim 1, wherein the porous ink-receiving layer further includes a binder.

3. A print medium as in claim 2, wherein the binder is present in the ink-receiving layer at from 0.01 wt % to 25 wt %.

4. A print medium as in claim 2, wherein the binder includes a member selected from the group consisting of polyvinyl alcohols; water-soluble copolymers of polyvinyl alcohols including copolymer of polyvinyl alcohol and poly (ethylene oxide) and copolymer of polyvinyl alcohol and polyvinyl amine; cationic polyvinyl alcohols; acetoacetylated polyvinyl alcohols; polyvinyl acetate, polyvinyl pyrrolidone; modified starches; water soluble cellulose derivatives; polyacrylamides; casein; gelatin; soybean protein; silyl-modified polyvinyl alcohol; conjugated diene copolymer latexes; acrylic polymer latexes; vinyl polymer latexes; functional group-modified latexes; aqueous binders of thermosetting resins; synthetic resin; and combinations thereof.

5. A print medium as in claim 4, wherein the binder includes polyvinyl alcohol.

6. A print medium as in claim 1, wherein the amine-functionalized particulates and epoxy-functionalized particulates are covalently attached to one another through a bonding reaction between an amine of the amine functionalized particulates and an epoxy of the epoxy-functionalized particulates.

7. A print medium as in claim 1, wherein the amine-functionalized particulates and the epoxy-functionalized particulates independently include metal oxide or semi-metal oxide particulates selected from the group consisting of silica, alumina, boehmite, silicate, titania, zirconia, calcium carbonate, clays, and combinations thereof.

8. A print medium as in claim 1, wherein the amine-functionalized particulates include organosilane reagents reacted with the metal oxide or semi-metal oxide particulates, said organosilane reagents being selected from the group consisting of 3-aminopropyltrimethoxysilane, 3-aminopropyltriethoxysilane, 3-aminoethylaminopropyltrimethoxysilane, 3-aminoethylaminopropyltriethoxysilane, 3-aminoethylaminoethylaminopropyltrimethoxysilane, 3-aminoethylaminoethylaminopropyltriethoxysilane, 3-aminopropylsilsesquioxane, bis-(3-trimethoxysilylpropyl)amine, N-benzyl-N-aminoethyl-3-aminopropyltrimethoxysilane hydrochloride, N-phenyl-3-aminopropyltrimethoxysilane, N-(2-aminoethyl)-3-aminopropyltrimethoxysilane, 3-(triethoxysilylpropyl)-diethylenetriamine, and poly(ethyleneimine) trimethoxysilane.

9. A print medium as in claim 1, wherein the epoxy-functionalized particulates include organosilane reagents reacted with the metal oxide or semi-metal oxide particulates, said organosilane reagents being selected from the group consisting of 3-glycidoloxypropyltrimethoxysilane and beta-(3,4-epoxycyclohexyl) ethyltrimethoxysilane, 5,6-epoxyhexyltrimethoxysilane, epoxypropylheptaisobutyl-T8-silsesquioxane, 3-(glycidoxypropyl)dimethylethoxysilane, (3-glycidoxypropyl)methyldiethoxysilane, and (3-glycidoxypropyl)methyldimethoxysilane.

10. A print medium as in claim 1, wherein said particulates further include a third portion of quaternary ammonium salt-functionalized particulates or aluminum chloride hydrate-functionalized particulates.

11. A print medium as in claim 1, wherein the molar ratio of the amine groups to the epoxy groups is about 1:1.

12. A print medium as in claim 1, further comprising a curing agent present at from 0.01% to 20% by moles based on the total amount of epoxy functional groups.

13. A print medium as in claim 1, wherein the porous ink-receiving layer has been printed upon with a dye-based ink-jet ink.

14. A print medium as in claim 1, wherein the porous ink-receiving layer has been printed upon with a pigment-based ink-jet ink.

15. A method of preparing a print medium, comprising coating a media substrate with a coating composition to form an ink-receiving layer, said coating composition having metal oxide or semi-metal oxide particulates including a first portion of amine-functionalized particulates and a second portion of epoxy functionalized particulates, wherein amine functionalized particulates are covalently coupled to epoxy-functionalized particulates, and wherein the molar ratio of amine groups of the amine-functionalized particulates to epoxy groups of the epoxy-functionalized particulates is from about 3:1 to 1:3.

16. A method as in claim 15, wherein the coating composition further includes a binder.

17. A method as in claim 16, wherein the binder is present at from 0.01 wt % to 25 wt %.

18. A method as in claim 16, wherein the binder includes a member selected from the group consisting of polyvinyl alcohol; water-soluble copolymers of polyvinyl alcohols including copolymer of polyvinyl alcohol and poly(ethylene oxide) and copolymer of polyvinyl alcohol and polyvinyl amine; cationic polyvinyl alcohols; acetoacetylated polyvinyl alcohols; polyvinyl acetate; polyvinyl pyrrolidone; modified starches; water soluble cellulose derivatives; polyacrylamides; casein; gelatin; soybean protein; silyl-modified polyvinyl alcohol; conjugated diene copolymer latexes; acrylic polymer latexes; vinyl polymer latexes; functional group-modified latexes; aqueous binders of thermosetting resins; synthetic resin; and combinations thereof.

19. A method as in claim 18, wherein the binder includes polyvinyl alcohol.

20. A method as in claim 15, wherein the amine-functionalized particulates and epoxy-functionalized particulates are covalently attached to one another through a bonding reaction between an amine of the amine functionalized particulates and an epoxy of the epoxy-functionalized particulates.

21. A method as in claim 15, wherein the amine-functionalized particulates and the epoxy-functionalized particulates independently include metal oxide or semi-metal oxide particulates selected from the group consisting of silica, alumina, boehmite, silicate, titania, zirconia, calcium carbonate, clays, and combinations thereof.

22. A method as in claim 15, wherein the amine-functionalized particulates include organosilane reagents reacted with the metal oxide or semi-metal oxide particulates, said organosilane reagents being selected from the group consisting of 3-aminopropyltrimethoxysilane, 3-aminopropyltriethoxysilane, 3-aminoethylaminopropyltrimethoxysilane, 3-aminoethylaminopropyltriethoxysilane, 3-aminoethylaminoethylaminopropyltrimethoxysilane, 3-aminoethylaminoethylaminopropyltriethoxysilane, 3-aminopropylsilsesquioxane, bis-(3-trimethoxysilylpropyl) amine, N-benzyl-N-aminoethyl-3-aminopropyltrimethoxysilane hydrochloride, and N-phenyl-3-aminopropyltrimethoxysilane, N-(2-aminoethyl-3-aminopropyltrimethoxysilane, 3-(triethoxysilylpropyl)-diethylenetriamine, and poly(ethyleneimine) trimethoxysilane.

23. A method as in claim 15, wherein the epoxy-functionalized particulates include organosilane reagents reacted with the metal oxide or semi-metal oxide particulates, said organosilane reagents being selected from the group consisting of 3-glycidoloxypropyltrimethoxysilane , beta-(3,4-epoxycyclohexyl) ethyltrimethoxysilane, 5,6-epoxyhexyltrimethoxysilane, epoxypropylheptaisobutyl-T8-silsesquioxane, 3-(glycidoxypropyl)dimethylethoxysilane, (3-glycidoxypropyl)methyldiethoxysilane, and (3-glycidoxypropyl)methyldimethoxysilane.

24. A method as in claim 15, wherein said particulates further include a third portion of quaternary ammonium salt-functionalized particulates or aluminum chloride hydrate-functionalized particulates.

25. A method as in claim 15, wherein the molar ratio of the amine groups to the epoxy groups is about 1:1.

26. A method as in claim 15, wherein said coating composition further comprises a curing agent present at from 0.01% to 20% by moles based on the total amount of epoxy functional groups.

* * * * *